United States Patent [19]

Navara

[11] 3,949,984

[45] Apr. 13, 1976

[54] BREATHING EXERCISER

[76] Inventor: Joseph Navara, 2105 W. Walton, Chicago, Ill. 60622

[22] Filed: Mar. 17, 1975

[21] Appl. No.: 559,071

Related U.S. Application Data

[63] Continuation of Ser. No. 423,216, Dec. 10, 1973, abandoned.

[52] U.S. Cl. ..... 272/57 F; 46/88

[51] Int. Cl.[2] ..... A63B 23/00

[58] Field of Search ..... 84/465, 466; 46/87, 88, 46/90; 272/57 F; 128/1 R, 2.08

[56] References Cited

UNITED STATES PATENTS

| | | | |
|---|---|---|---|
| 2,635,387 | 4/1953 | Anderson | 46/90 |
| 3,333,844 | 8/1967 | Jurschak | 272/57 F |
| 3,749,083 | 7/1973 | Mathes, Jr. | 128/1 R |

*Primary Examiner*—Richard C. Pinkham
*Assistant Examiner*—Harry G. Strappello
*Attorney, Agent, or Firm*—Edward D. Gilhooly

[57] ABSTRACT

A breathing exerciser comprising an inflatable member, and a holder having a proximal end for placement in a user's mouth and a distal end for retention of the inflatable member. The holder has a main lumen extending through the holder between the proximal and distal ends and communicating with the inside of the inflatable member. The holder also has an opening communicating between the main lumen and the outside of the holder intermediate its proximal and distal ends, in order that inflation and deflation of the inflatable member may be controlled by placement of the user's fingers on the opening.

2 Claims, 2 Drawing Figures

10
12
14
2
20
22
34
2
26

10
12
F
20
38
40a
16
22
26
14
24
30
40b
32
34
T

BREATHING EXERCISER

This is a continuation, of application Ser. No. 423,216 filed Dec. 10, 1973, now abandoned.

BACKGROUND OF THE INVENTION

1. Field of the invention.

The present invention relates to an exercising device, and more particularly to a device for use in breathing exercises.

2. Description of the prior art.

For certain maladies of the bronchi and lungs, such as emphysema, a physician may often wish to prescribe an exercising device for development of the respiratory system. Such an exerciser may take the form of an inflatable device which is repeatedly inflated and deflated by the patient to strengthen and develop the lungs. To the present, inflatable devices have been unsatisfactory for such a purpose since they have been inconvenient and not adapted for such use.

A device for forcing air through the nostrils and eustachian tubes into the middle ear is disclosed in Mathes, Jr. U.S. Pat. No. 3,749,083.

SUMMARY OF THE INVENTION

A principal feature of the present invention is the provision of a breathing exerciser of simplified construction and which is convenient in use.

The exerciser of the present invention comprises an inflatable member, and a holder having a proximal end for placement in a user's mouth and a distal end for retention of the inflatable member. The holder has a main lumen extending through the holder between the proximal and distal ends and communicating with the inside of the inflatable member. The holder also has opening means communicating between the lumen and the outside of the holder intermediate its proximal and distal ends.

Thus, a feature of the present invention is that inflation and deflation of the inflatable member may be controlled by placement of the user's fingers on the opening means.

Another feature of the invention is that in a preferred embodiment the opening means comprises a pair of passageways which open on the top and bottom of the holder in order that inflation and deflation of the device may readily be controlled by the user's thumb and forefinger.

A further feature of the invention is that the opening means comprises at least one passageway which is directed away from the user's face when the holder is placed in the user's mouth to deflect escaping air away from the user's face.

Still another feature of the invention is that the holder includes a tapered portion adjacent its proximal end for fitment of the holder in the user's mouth and for orientation of the holder when placed in the mouth.

Further features will become more fully apparent in the following description of this invention and from the appended claims.

DESCRIPTION OF THE PREFERRED EMBODIMENT

Figure 1:
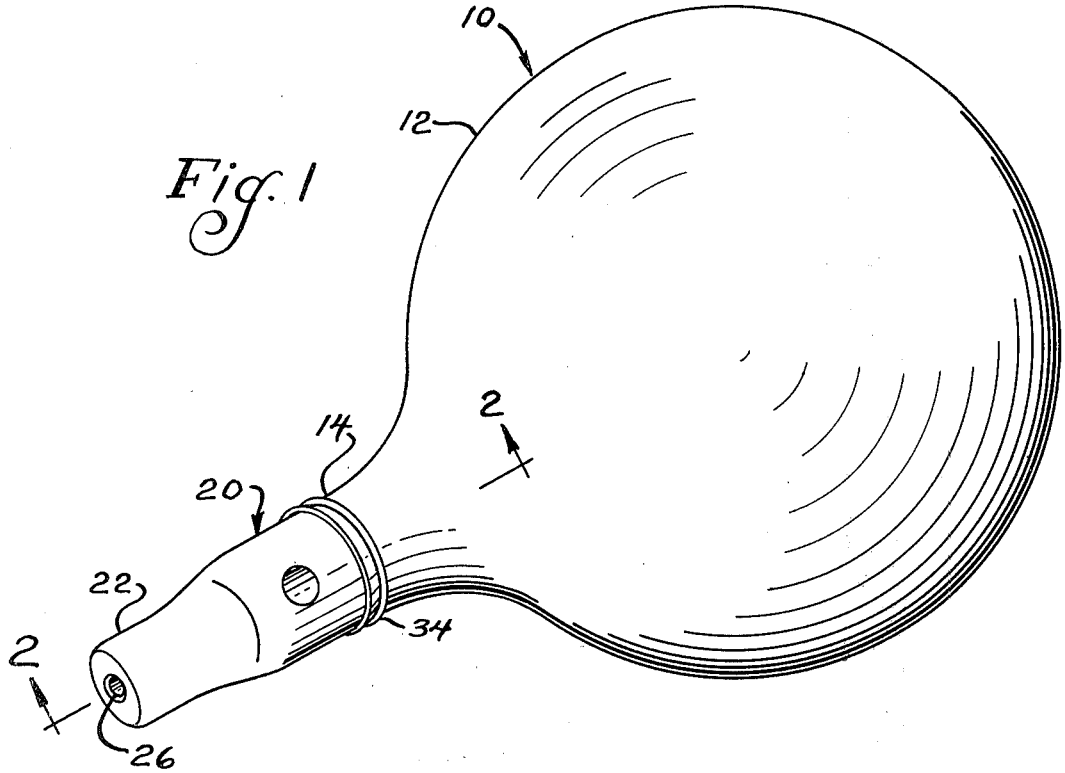
FIG. 1 is a perspective view of the breathing exerciser of the present invention.
Figure 2:
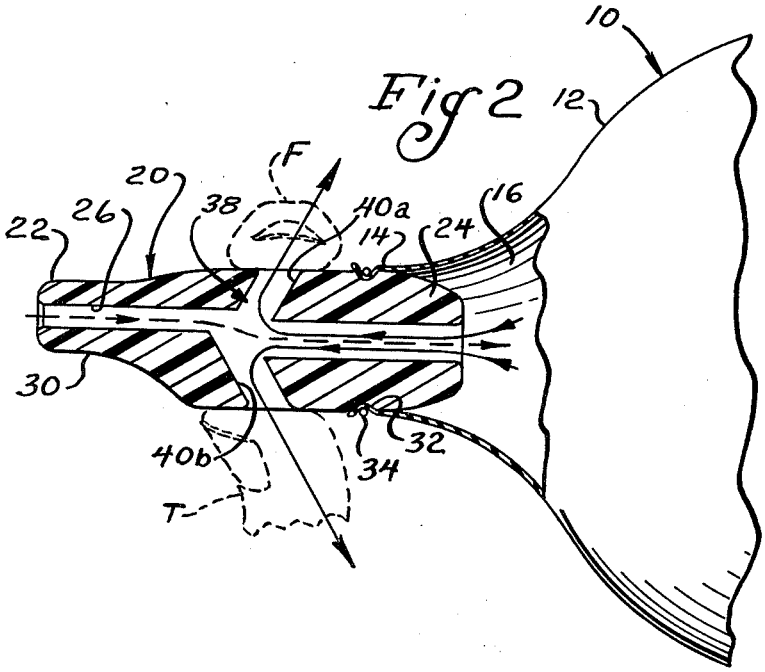
FIG. 2 is a fragmentary view, taken partly in section, showing a holder and the open end of an inflatable member in the exerciser of FIG. 1.

Referring now to FIGS. 1 and 2, there is shown a device generally designated 10 for use in breathing exercises and development of the bronchi and lungs. The exercising device 10 includes an inflatable member 12, such as a rubber balloon, having an open end 14 and an internal chamber 16. The exercising device 10 includes a holder generally designated 20 having a proximal end 22 for placement in a user's mouth, a distal end 24 for retention of the inflatable member 12, and a main lumen 26 extending through the holder 20 between the proximal and distal ends 22 and 24, such that the lumen 26 communicates with the chamber 16 of the inflatable member adjacent the distal end 24 of the holder 20.

The holder 20 has a tapered portion 30 adjacent its proximal end 22 for fitment of the holder in the user's mouth and for orientation of the holder when placed in the mouth. The holder 20 also has an annular groove 32 adjacent its distal end 24, and the open end 14 of the inflatable member 12 is secured to the holder 20 by a rubber band 34 which releasably secures the open end 14 in the groove 32. Thus, the inflatable member 12 may be readily replaced on the holder 20, if desired.

The holder 20 has opening means generally designated 38 communicating between the main lumen 26 and the outside of the holder intermediate its proximal and distal ends 22 and 24 for controlling inflation and deflation of the inflatable member 12. In a preferred embodiment, the opening means 38 comprises a pair of passageways **40*a* and 40*b* which extend from the main lumen 26 to the outside of the holder 20, and which open on the outside of the holder at its top and bottom when the holder is properly positioned in the user's mouth, with the orientation of the holder being defined by the tapered portion 30 of the holder 20. It is preferred that the passageways 40*a*** and *b* are directed away from the user's face, as shown in FIG. 2, when the holder 20 is placed in the user's mouth, for a purpose which will be described below.

In use of the device 10 for exercising the bronchi and lungs, the proximal end 22 of the holder 20 is first inserted into the user's mouth. Next, the thumb T and forefinger F of the user are placed over the outer ends of the passageways **40*a* and 40*b* to prevent escape of air from the main lumen 26 through the passageways. Air is then expelled from the user's lungs through the main lumen 26, as indicated by the direction of the dotted arrows in FIG. 2, to inflate the member 12. The air in the inflated member 12 may then be released by moving the thumb T or forefinger F, or both, away from the outer ends of the passageways 40*a* and 40*b*, such that the air passes from the inflated member 12 through the lumen and passageways to the outside of the holder, as indicated by the direction of the solid arrows in FIG. 2. The passageways 40*a*** and *b* are directed away from the user's face, as previously described, to deflect the escaping air away from the face.

Thus, there has been disclosed a device according to the present invention of simplified construction for convenient use in developing the bronchi and lungs. If desired, the inflatable member 12 of the device 10 may be inflated and deflated without removing the holder from the user's mouth. For example, air may be drawn through the passageways 40*a* and *b* into the user's lungs, after which the passageways are closed. The user may expel the air into the inflatable member, and then release the passageway openings to deflate the member 12, after which the user may again inhale through the passageways. Thus, the user may repetitively inflate and deflate the member 12 without removing the holder from his mouth, if desired. Alternatively, the user may maintain the passageways 40*a* and *b* closed while repetitively inhaling about the proximal end 22 of the holder 20 and expelling such air into the inflatable member 12. After the member 12 has been inflated to a desired extent, the user may release the passageway openings to deflate the member 12. Accordingly, the device 10 permits convenient exercise of the user's respiratory system since it is unnecessary to remove the device from the mouth during use.

The foregoing detailed description is given for clearness of understanding only, and no unnecessary limitations should be understood therefrom, as modifications will be obvious to those skilled in the art.

I claim:

1. A bronchial breathing exerciser, comprising;

an inflatable member;

a holder having a longitudinal axis extending to a proximal end for placement in a user's mouth and a distal end for retention of the inflatable member;

a main lumen extending through the holder between said proximal and distal ends and communicating with the inside of said inflatable member;

opening means having a pair of passageways each on opposite sides of the holder intermediate its proximal and distal ends and communicating between said lumen and the outside, whereby inflation and deflation of the inflatable member may be controlled by placement of the user's fingers on said opening means;

each of said passageways having a longitudinal axis extending in a direction toward said distal end to direct expelled air away from the user, said distal end including means to retain the inflatable member to the holder in spaced relationship to the passageways to permit either fluid communication between the passageway and the outside or access to the passage for control by a user, said retaining means comprising annular groove adjacent the distal end for securing the inflatable member to the holder and said holder includes a tapered portion adjacent its proximal end for fitment in the user's mouth and for orientation of the holder when placed in the mouth.

2. The exerciser of claim 1 wherein said pair of passageways open on the top and the bottom of the holder when the holder is in position in the user's mouth.

* * * * *